US010844635B2

(12) United States Patent
Olson

(10) Patent No.: US 10,844,635 B2
(45) Date of Patent: Nov. 24, 2020

(54) LOW CLOSURE FORCE MOTORIZED LATCH

(71) Applicant: ILLINOIS TOOL WORKS INC., Glenview, IL (US)

(72) Inventor: Jonathan H. Olson, Sussex, WI (US)

(73) Assignee: Illinois Tool Works Inc., Glenview, IL (US)

( * ) Notice: Subject to any disclaimer, the term of this patent is extended or adjusted under 35 U.S.C. 154(b) by 1066 days.

(21) Appl. No.: 15/306,498

(22) PCT Filed: Mar. 27, 2015

(86) PCT No.: PCT/US2015/022899

§ 371 (c)(1),
(2) Date: Oct. 25, 2016

(87) PCT Pub. No.: WO2015/167716

PCT Pub. Date: Nov. 5, 2015

(65) Prior Publication Data

US 2017/0051535 A1 Feb. 23, 2017

Related U.S. Application Data

(60) Provisional application No. 61/987,079, filed on May 1, 2014.

(51) Int. Cl.
*D06F 39/14* (2006.01)
*E05B 17/00* (2006.01)
(Continued)

(52) U.S. Cl.
CPC ..... *E05B 65/001* (2013.01); *D06F 39/14* (2013.01); *E05B 17/0029* (2013.01);
(Continued)

(58) Field of Classification Search
CPC .. E05B 65/001; E05B 17/0029; E05B 63/127; E05B 47/0012; E05B 2047/0077;
(Continued)

(56) References Cited

U.S. PATENT DOCUMENTS 4,497,513 A 2/1985 Sasaki
5,062,668 A * 11/1991 Onderka ..... F16P 3/10 200/61.64
(Continued)

FOREIGN PATENT DOCUMENTS

DE 102009024503 B3 9/2010
DE 102012204490 A1 9/2013
(Continued)

OTHER PUBLICATIONS

ISR and WO for PCT/US2015/022899 dated Jun. 17, 2015.

*Primary Examiner* — Kristina R Fulton
*Assistant Examiner* — Thomas L Neubauer
(74) *Attorney, Agent, or Firm* — Boyle Fredrickson, S.C.

(57) ABSTRACT

A motorized appliance latch provides for a spring-biased strike grip that can be engaged and disengaged from the strike with low force but then locked in a close position during closing of the door to allow the strike to be retained against countervailing gasket compression forces. In this way, an arbitrarily low force may be required by the consumer to close or open the door when the door is unsealed by the motor.

18 Claims, 5 Drawing Sheets

(51) Int. Cl.

| | |
|---|---|
| ***E05B 47/00*** | (2006.01) |
| ***E05B 65/00*** | (2006.01) |
| ***E05B 63/12*** | (2006.01) |
| ***E05C 19/02*** | (2006.01) |

(52) U.S. Cl.
CPC ..... *E05B 47/0012* (2013.01); *E05B 63/127* (2013.01); *E05C 19/026* (2013.01); *E05B 2047/002* (2013.01); *E05B 2047/0077* (2013.01)

(58) Field of Classification Search
CPC ... E05B 2047/002; E05C 19/026; D06F 39/14
USPC .... 292/DIG. 4, 95, 116, 117, 119, 213, 214, 292/219, 220
See application file for complete search history.

(56) References Cited

U.S. PATENT DOCUMENTS

| | | | | |
|---|---|---|---|---|
| 7,306,266 | B2 | 12/2007 | Hapke et al. | |
| 7,393,026 | B2 * | 7/2008 | Ikeda | E05C 19/02 292/341.15 |
| 7,731,806 | B2 | 6/2010 | Hapke | |
| 8,006,521 | B2 * | 8/2011 | Rocchitelli | D06F 37/42 134/57 DL |
| 8,376,418 | B2 | 2/2013 | Osvatic et al. | |
| 9,885,141 | B2 * | 2/2018 | Becchio | D06F 39/14 |

FOREIGN PATENT DOCUMENTS

| | | | | |
|---|---|---|---|---|
| EP | 0919687 | A1 | 6/1999 | |
| EP | 2578134 | A2 * | 4/2013 | E05B 17/0029 |
| EP | 2578134 | A2 | 4/2013 | |

* cited by examiner

LOW CLOSURE FORCE MOTORIZED LATCH

CROSS-REFERENCE TO RELATED APPLICATIONS

This application is National Phase of International Application No. PCT/US2015/022899, filed Mar. 27, 2015, and claims the benefit of U.S. provisional application 61/987,079 filed May 1, 2014 and hereby incorporated by reference.

BACKGROUND OF THE INVENTION

The present invention relates to a latching mechanism for doors on household appliances and particularly to low profile latching mechanisms that operate with low closure force and accommodate changes in the elasticity of a door gasket.

Appliances such as dishwashers and front-loading washing machines may have an access door with a gasket that must be compressed to seal water within a washing chamber. Small area, highly compliant gaskets may be sealed by pressure from the user during the closing of the door. The gasket may then be held in a compressed state by a latch mechanism.

Gaskets that require more force may be compressed by a latch mechanism having a lever operated by the user to engage a catch and draw the catch inward with a lever advantage to compress the gasket and hold the door shut.

A closing lever may be avoided in latch mechanisms that provide an "over-center" spring mechanism. During initial stages of closing of the door, closing force on the door is used to energize a spring. When the door closes past the over-center point, the spring releases its energy in a manner to pull the door fully closed. An example of an over-center spring mechanism is described in U.S. Pat. No. 4,497,513 to Sasaki.

U.S. Pat. Nos. 7,306,266 and 8,376,418, assigned to the assignee of the present invention and hereby incorporated by reference, teach a latch where a latch spring is compressed (energized) when the door is opened and this energy is released when the door is closed, assisting the user in compressing the door gasket. In this design, the latching mechanism "floats" on a spring-loaded lever to accommodate aging of the gasket. As the gasket ages and compresses more, the latching mechanism moves further "inboard" on the spring-loaded lever to ensure complete closure.

In these designs, a significant amount of force is required to open the door in order to store energy in the spring mechanism. In addition, the high forces of spring compression in the open door require substantial closing force in order to actuate the mechanism against the inevitable friction incident to a mechanism storing spring energy.

U.S. Pat. No. 7,731,806, assigned to the assignee of the present invention and hereby incorporated by reference, teaches an appliance latch describing a motorized latch which eliminates the need for the consumer to provide the force necessary to compress the gasket making it easier for the consumer to close and seal the door.

SUMMARY OF THE INVENTION

The present invention provides a motorized latch that allows the consumer to open and close the door with very low force and without the need to actuate a latch handle, while firmly holding the door against the forces needed to compress an appliance gasket. Features of some embodiments of the invention provide an extremely low profile and allow construction of the principal elements of the latch from rustproof, injection molded thermoplastic.

Specifically, in one embodiment, the invention provides an appliance latch for retaining a strike and includes a housing providing an aperture for receiving the strike from a first direction and holding an electric motor and a strike grip movable by the electric motor between an outward unlock position toward the first direction along an axis and an inward locked position away from the first direction. The strike grip provides at least one spring-biased element, the spring-biased element being movable when the strike grip is in the outward unlock position to receive and releasably retain the strike in response to manually applied engagement force from the first direction and to release the strike in response to a manually applied disengagement force opposite the first direction. A strike grip lock blocks movement of the spring-biased element to release the strike in response to the manually applied force opposite the first direction when the strike grip is in the inward locked position.

It is thus a feature of at least one embodiment of the invention to minimize the force necessary for the consumer to close the door while ensuring the door is held closed during gasket compression. The spring-loaded strike grip provides a positive sense of closure and an engagement force may be arbitrarily selected independently of the requirements of gasket compression.

The spring-biased element may include two opposed jaws spring-biased to close about the strike when the strike is received therebetween.

It is thus a feature of at least one embodiment of the invention to provide a broad contact between the strike grip and the strike facilitating the fabrication of these elements from thermoplastic rather than metal.

The jaws may be urged toward a closed position by an axially spring-biased ridge engaging corresponding shoulders of the jaws.

It is thus a feature of at least one embodiment of the invention to provide a spring-biasing that also allows the latch to accommodate changes in gasket compliance over time as will be described below.

The motor may move a closer element and the strike grip may be attached to a support floating with respect to the closer element spring-biased against the closer element away from the first direction.

It is thus a feature of at least one embodiment of the invention to allow the strike grip to float as biased by a spring element to accommodate different amounts of compression of the gasket available as the gasket ages.

The motor may move the strike grip along the axis by rotating an axially threaded member engaging a correspondingly threaded support of the strike grip.

It is thus a feature of at least one embodiment of the invention to provide an extremely low profile actuator mechanism that may apply high compressive forces while being implemented in thermoplastic.

The motor may communicate through a gear train with gear teeth extending radially outward from axially threaded member.

It is thus a feature of at least one embodiment of the invention to allow a low-power DC motor to provide high compressive forces necessary for gasket sealing.

The gear train may include a worm gear driven by a shaft of the motor extending perpendicular to the axis.

It is thus a feature of at least one embodiment of the invention to provide a low profile design in which the motor axis can be perpendicular to the actuator axis.

The strike grip lock may be a collar surrounding the jaws to prevent them from opening to release the strike when the strike grip is in the inward locked position.

It is thus a feature of at least one embodiment of the invention to provide a simple locking mechanism that limits the necessary strength of the jaws by supporting them from the outer surface.

The collar may be attached to the closer element to float axially with respect to the closer element and spring-biased away from the closer element toward the first direction.

It is thus a feature of at least one embodiment of the invention to allow the collar to provide a protective shroud around the jaws in their extended position.

The appliance latch assembly may include the strike providing an elongate element extending from a flange and terminating at a bulbous end.

It is thus a feature of at least one embodiment of the invention to provide a latch assembly system that may work with a strike readily fabricated from thermoplastic materials.

These particular features and advantages may apply to only some embodiments falling within the claims and thus do not define the scope of the invention.

DETAILED DESCRIPTION OF THE INVENTION

Figure 1:
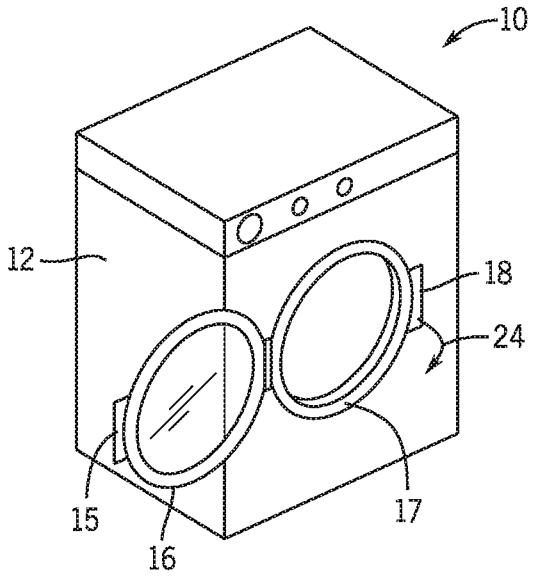
FIG. 1 is a simplified perspective view of an appliance suitable for use with the present invention showing the appliance door and one possible location of the appliance latch and strike of the present invention.

Referring now to FIG. 1, an appliance 10 such as a frontloading clothes washing machine may have a cabinet 12 opening along a front face to provide access to a washing chamber within the interior of the cabinet 12. The front face may include a gasket 17 that is compressed with closure of a door 16, the latter of which is sized to cover the front face of the cabinet 12 to prevent access to its interior during operation and to prevent leakage of water during the wash cycle. When closed, the door 16 may compress the gasket 17 positioned around the door opening to seal the washing chamber against water leakage.

The door 16 may be hinged, for example, at a side edge and the opposite side edge held closed by means of a latch 18 held in the cabinet 12 and receiving a strike 15 attached to the door and extending toward the front face of the cabinet 12. It will be understood generally that the positions of the strike 15 and latch 18 may be reversed.

Figure 2:
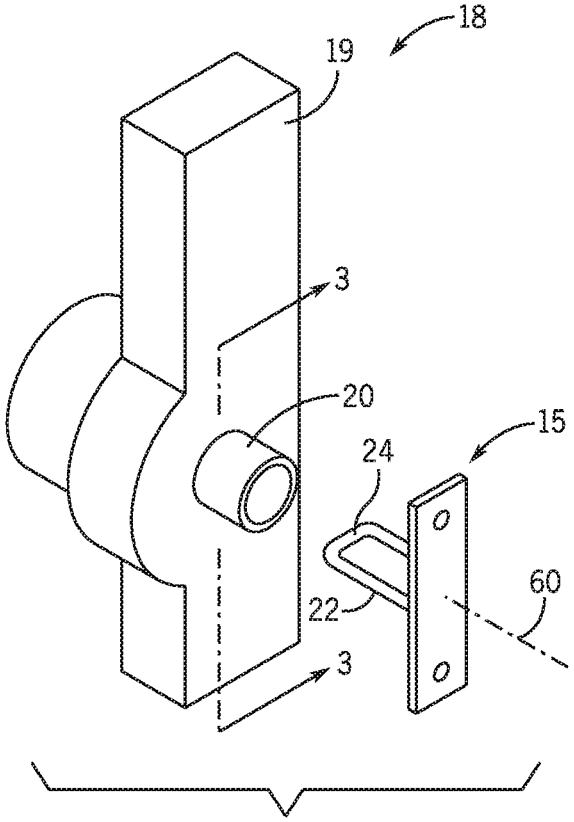
FIG. 2 is a perspective view of a strike as may be attached to the appliance door and a motorized appliance latch that may be attached to the appliance.

Referring now to FIG. 2, the latch 18 may have a housing 19 from which a locking collar 20 may extend outward in sliding relationship to the housing 19. With closure of the door 16, the latch 18 may receive the strike 15 through the locking collar 20. In this embodiment, the strike 15 is a loop hasp 22 that provides a bar 24 generally perpendicular to the axis 60 of engagement of the strike 15 and the latch 18.

Figure 3:
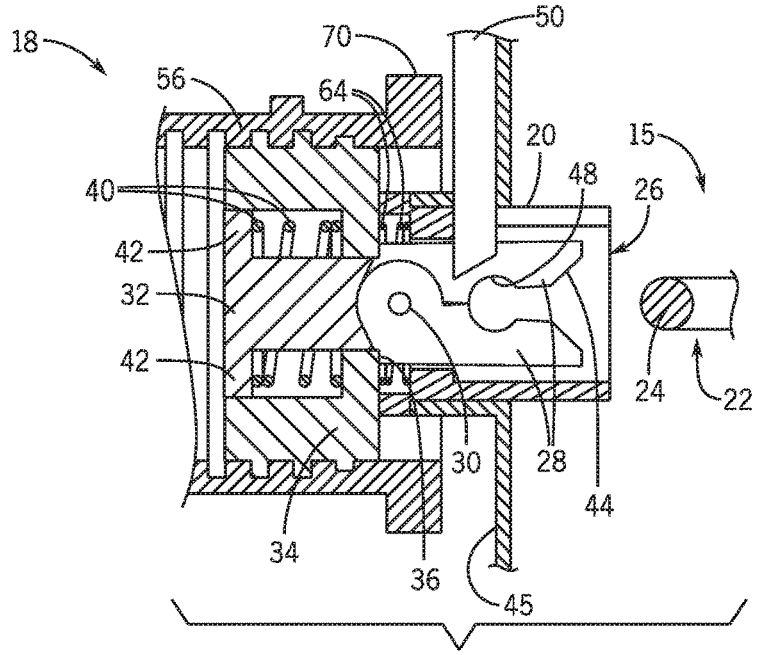
FIG. 3 is a cross-sectional, fragmentary view taken along lines 3-3 of FIG. 2 showing the strike grip jaws held within a lock collar prior to receiving the strike, the jaws supported on threaded closer plate received by a threaded rotating sleeve.
Figure 4:
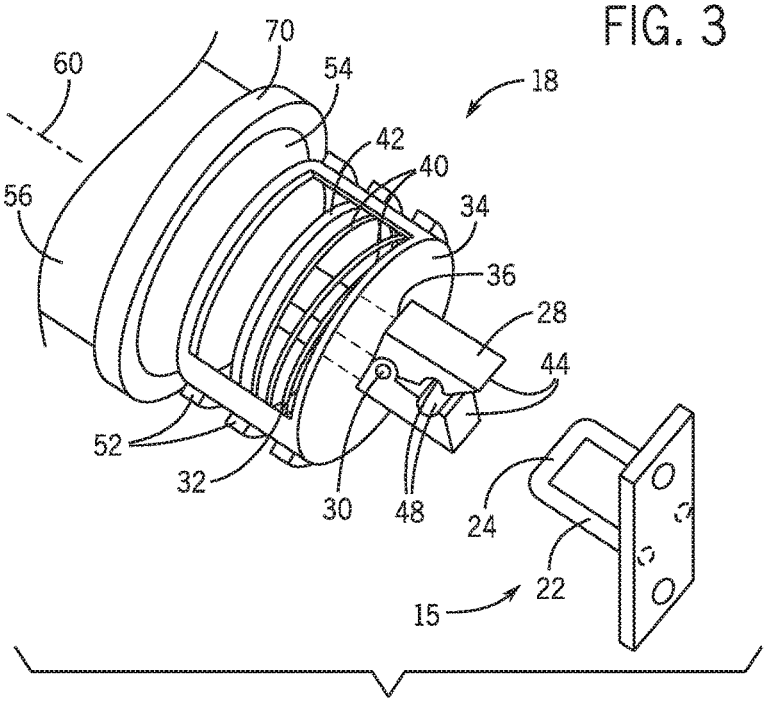
FIG. 4 is an exploded partial fragmentary view of the strike, the strike gripper, threaded closer plate, and threaded rotating sleeve of FIG. 3.

Referring now to FIGS. 3 and 4, a strike grip 26 may be positioned within the locking collar 20 having upper and lower jaws 28 pivoting at a rear end about a vertical or horizontal pivot 30 (depending on the orientation of the bar 24 and the type of strike 15) as attached to a pivot retainer column 32. The pivot retainer column 32 extends rearwardly through a closer plate 34 whose front surface may press against shoulders 36 of the rear edges of the upper and lower jaws 28 to move the jaws 28 into closure against each other. A helical compression spring 40 fits between a flange 42 on the rear of the retainer column 32 and the rear surface of the closer plate 34 to bias the closer plate 34 against the shoulders 36 to promote closure of the jaws 28.

Figure 5:
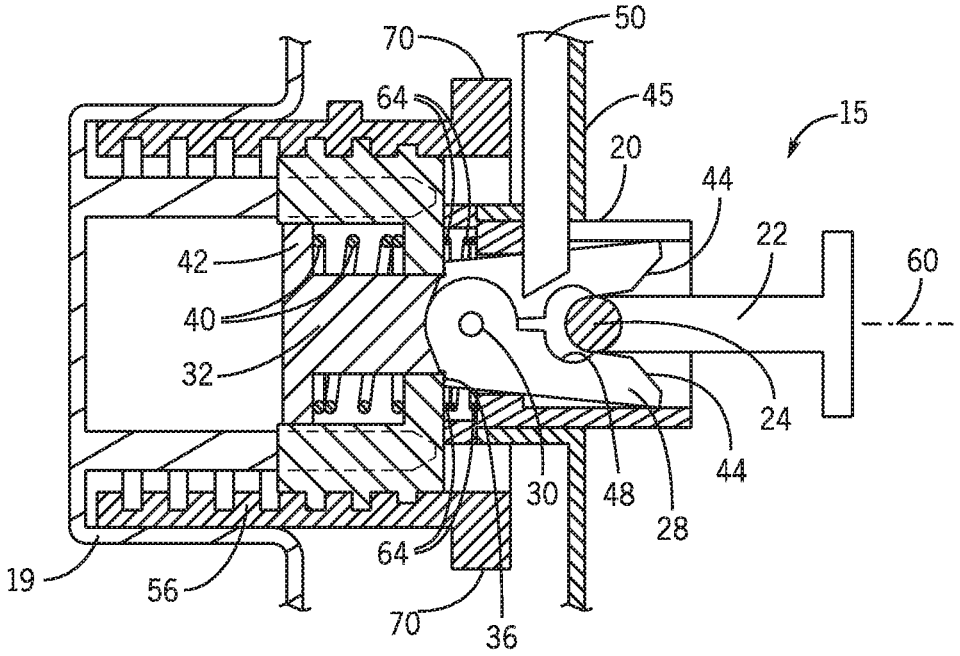
FIG. 5 is figure similar to that of FIG. 3 showing engagement of the strike with the strike gripper.

Referring now to FIG. 5, with insertion of the bar 24 of the strike 15 in between the jaws 28 (facilitated by beveled leading edges 44 of the jaws 28 and a rounded leading edge of the bar 24), the jaws 28 may separate with shoulders 36 pushing back on the closer plate 34 against a helical compression spring 40 with respect to the column 32 until the horizontal bar 24 drops into horizontally extending hemi-cylindrical pockets 48 cut in the inner opposed faces of the jaws 28. These hemi-cylindrical pockets 48 allow the jaws 28 to close about the horizontal bar 24 within the closer plate 34 so that they may return to the position shown in FIG. 3.

When the horizontal bar 24 is positioned in the opposed hemi-cylindrical pockets, 48 it may press a switch actuator bar 50 signaling the presence of the strike 15 through a strike presence switch 77 (shown in FIG. 7), for example, a set of contacts or a photo interrupter. Opening and closing of the jaws 28 is possible when the pivot 30 is in a relatively forward position as shown with respect to the locking collar 20.

The spring force provided by helical spring 40 against the shoulders 36 allows the jaws 28 to be readily separated so that the consumer may engage the strike 15 within the jaws 28 with relatively low force and a force far less than the force required to compress the gasket 17 (shown in FIG. 1) or that would be required if the jaws 28 had to be spring-biased to an amount sufficient to retain the strike 15 within the jaws 28 against the opposing gasket compression force. Generally this force may be lower than that provided by standard magnetic cabinet hinge.

Referring now to FIGS. 4 and 5, the closer plate 34 may extend rearwardly to surround the flange 42 and provide radially outwardly extending helical thread teeth 52 that may engage corresponding inwardly extending receiving threads 54 on a surrounding concentric threaded rotating outer sleeve 56. Rotation of that threaded rotating outer sleeve 56 with respect to the closer plate 34, as will be discussed below, may serve to draw the closer plate 34 rearward along an axis 60 generally describing the engagement direction of the strike 15. With the rearward movement of the closer plate 34, the jaws 28 will also be pulled back as the spring 40 compresses between the flange 42 and the rear of the closer plate 34.

Figure 6:
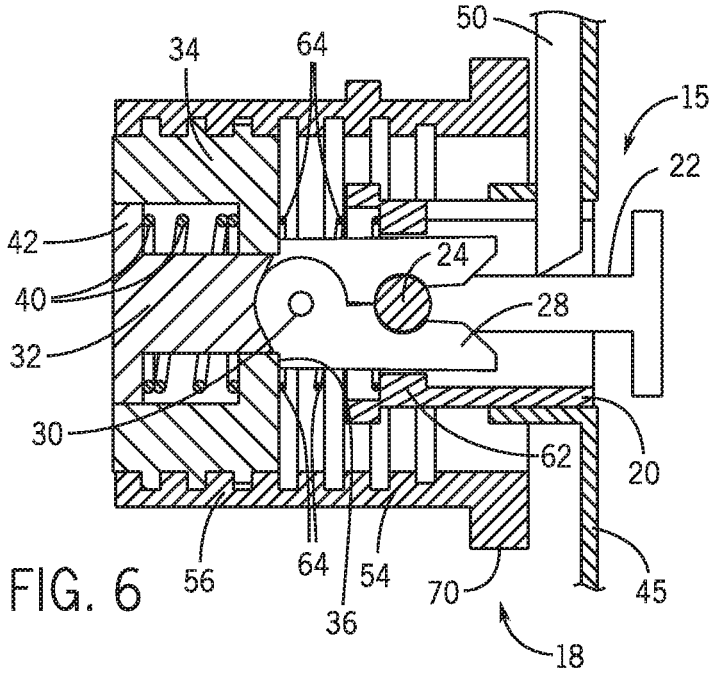
FIG. 6 is a figure similar to FIGS. 3 and 5 showing retraction of the strike into the lock collar preventing its release of the strike with retraction of the threaded closer plate into the threaded rotating sleeve with rotation of the latter.

Referring now to FIG. 6, as the jaws 28 are pulled backward, they are locked together by an interference ridge 62 extending radially inwardly about the rear inner surface of the locking collar 20. Initially the locking collar 20 forms a protective shroud around the jaws 28 and is restrained by a front wall 45 portion of the housing 19, but as the jaws 28 retract, the locking collar 20 is free to slide forward with respect to the jaws 28 under the influence of a helical bias spring 64. This sliding continues until the jaws 28 reach a solidly locked position, which occurs prior to the door exerting significant force on the gasket. Locking collar 20 then retracts with the jaws 28, thus minimizing any friction forces that would otherwise be imparted by locking collar 20 on jaws 28, allowing for low force movement of the jaws 28. In this way, the jaws 28 are prevented from opening, releasing the horizontal bar 24 as the force between the latch 18 and the strike 15 rises with compression of the gasket 17 (shown in FIG. 1). Total compression force exerted between the jaws 28 and the strike 15 is moderated by the ability of bar 24 to compress the helical compression spring 40 as the closer plate 34 moves rearwardly. In this way, the lock components are not overstressed with gradual hardening of the gasket 17 such as may substantially increase the closure force required.

Figure 7:
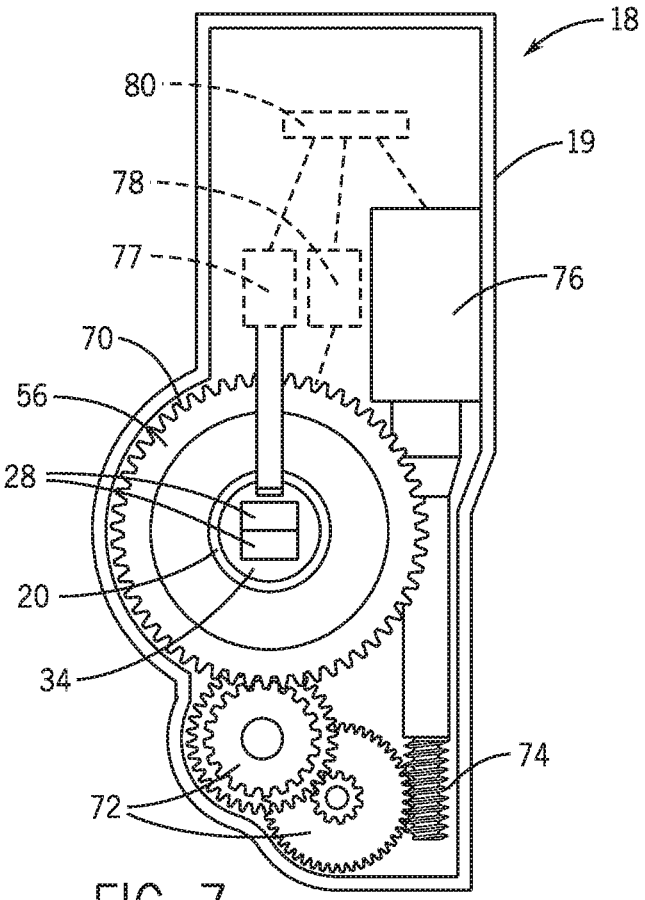
FIG. 7 is a phantom view of additional components of the appliance latch of the present invention showing a gear train for rotating the threaded rotating sleeve and a limit switch assembly.

Referring now to FIG. 7, the threaded rotating outer sleeve 56 may be rotated by means of integrated gear teeth 70 around the periphery of the threaded rotating outer sleeve 56 that may engage a gear train 72 driven by a helical worm gear 74, the latter rotated by a DC motor 76. A limit switch 78 which may be a set of contacts or a photo interrupter may serve to allow rotation of the threaded rotating outer sleeve 56 between predetermined positions represented by FIG. 3 and by FIG. 6 under command from the appliance control system. The limit switch 78 and the strike presence switch 77 may communicate with the electrical connector 80 on the housing 19 such as may also provide electrical signals to the motor 76. It is also contemplated that the limit switch 78 and strike presence switch 77 may communicate with internal circuitry of the latch 18 to provide a "smart" lock operating under the power of an appliance but with its own control.

Figure 8:
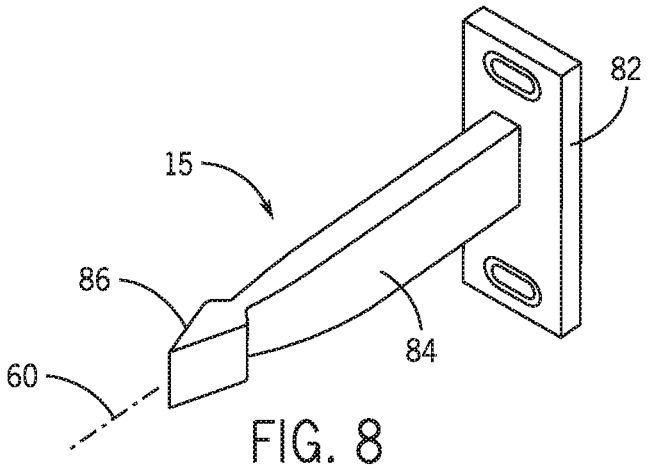
FIG. 8 is a perspective view of an alternative strike fabricated of thermoplastic material.

Referring now to FIG. 8, in an alternative embodiment the strike 15 may be constructed entirely of thermoplastic material and may include a flange 82, for example, for attaching to the door 16 having a stalk 84 extending along axis 60 terminating in a bulbous end 86 that serves the same purpose as the bar 24 described above. In this case the jaws 28 are rotated 90 degrees and adjusted so that they may fully close while accommodating the width of the stalk 84.

Figure 9:
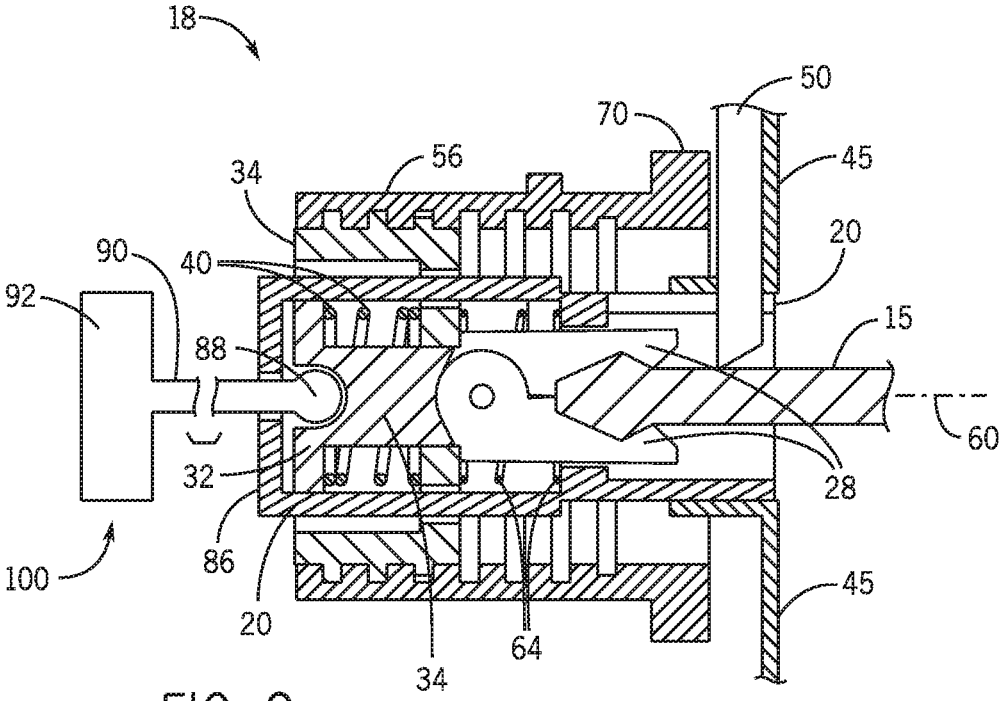
FIG. 9 is a figure similar to that of FIG. 6 showing alternative embodiment providing for an internal latch release and operation with the strike of FIG. 8.

Referring now to FIG. 9, generally the latch 18 may be released by pulling outward on the strike 15 along axis 60 in a direction to open the door 16 such as will draw the jaws 28 along with the strike 15. This is possible by compressing spring 40 and allows the jaws 28 move past the locking collar 20 so that they may open. Because releasing the latch 18 in this manner requires overcoming the spring 40, the latter sized to provide compression of the gasket 17 (shown in FIG. 1) substantial force may be necessary.

Alternatively, the spring 64 may be compressed by drawing the locking collar 20 backward to free the jaws 28. A mechanism for drawing the locking collar 20 backward may be provided by extending the locking collar 20 rearward behind the closer plate 34 to join to inwardly extending flange 86 that capture a ball head 88 of a released pull 100. The ball head 88 may attach to a tensile member 92 which passes rearward through the inwardly extending flange 86 to join with a handle 92. Handle 92 may be accessible within the appliance 10, for example, through an access door (not shown) to be pulled on by the consumer to release the latch 18 in the event of a power failure or the like.

The term "spring-biased" is contemplated to include both configurations requiring an external spring and relying on the natural spring-like elasticity of the material of the element. The term housing refers to a integrating framework that need not provide a hermetic enclosure.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. An appliance latch assembly for latching a door comprising:

a housing providing an aperture for receiving a strike from a first direction and defining movement of the strike into the aperture along a strike insertion axis, the housing holding:

an electric motor;

a strike grip movable in the first direction along the strike insertion axis by the electric motor from an outward unlock position toward an inward locked position further advanced along the strike insertion axis in the first direction further into the housing;

the strike grip providing at least one spring-biased element, the spring-biased element being movable when the strike grip is in the outward unlock position to receive and releasably retain the strike in response to a manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position.

2. The appliance latch assembly of claim 1 wherein the at least one spring-biased element is two opposed jaws spring-biased to close about the strike when the strike is received therebetween.

3. The appliance latch assembly of claim 2 wherein the jaws are urged toward a closed position by an axially spring-biased ridge engaging corresponding shoulders of the jaws.

4. The appliance latch assembly of claim 2 wherein the strike grip lock is a collar surrounding the jaws preventing them from opening to release the strike when the strike grip is in the inward locked position.

5. An appliance latch assembly for latching a door comprising:

a housing providing an aperture for receiving a strike from a first direction and holding:

an electric motor;

a strike grip movable by the electric motor between an outward unlock position toward the first direction along an axis and an inward locked position away from the first direction;

the strike grip providing at least one spring-biased element, the spring-biased element being movable when the strike grip is in the outward unlock position to receive and releasably retain the strike in response to a manually applied engagement force from the first direction and to release the strike in response to a manually applied disengagement force opposite the first direction;

a strike grip lock blocking movement of the spring-biased element to release the strike in response to the manually applied force opposite the first direction when the strike grip is in the inward locked position, wherein:

the at least one spring-biased element is two opposed jaws spring-biased to close about the strike when the strike is received therebetween;

the strike grip lock is a collar surrounding the jaws preventing them from opening to release the strike when the strike grip is in the inward locked position; and the motor moves a closer element and the collar is attached to the closer element to float axially with respect to the closer element and is spring-biased away from the closer element toward the first direction.

6. An appliance latch assembly for latching a door comprising:

a housing providing an aperture for receiving a strike from a first direction and holding:

an electric motor;

a strike grip movable by the electric motor between an outward unlock position toward the first direction along an axis and an inward locked position away from the first direction;

the strike grip providing at least one spring-biased element, the spring-biased element being movable when the strike grip is in the outward unlock position to receive and releasably retain the strike in response to a manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position, wherein the motor moves a closer element and the strike grip is attached to a support floating with respect to the closer element and is spring-biased against the closer element away from the first direction.

7. An appliance latch assembly for latching a door comprising:

a housing providing an aperture for receiving a strike from a first direction and holding:

an electric motor;

a strike grip movable by the electric motor between an outward unlock position toward the first direction along an axis and an inward locked position away from the first direction;

the strike grip providing at least one spring-biased element, the spring-biased element being movable when the strike grip is in the outward unlock position to receive and releasably retain the strike in response to a manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position, wherein the motor moves the strike grip along the axis by rotating an axially threaded member engaging a correspondingly threaded support of the strike grip.

8. The appliance latch assembly of claim 7 wherein the motor communicates through a gear train with gear teeth extending radially outward from the axially threaded member.

9. The appliance latch assembly of claim 8 wherein a gear train includes a worm gear driven by a shaft of the motor extending perpendicular to the axis.

10. The appliance latch assembly of claim 7 wherein the axially threaded member is an outer sleeve having inwardly extending threads and surrounding a telescoping inner sleeve having outwardly extending threads providing the correspondingly threaded support, and wherein the strike grip provides two opposed jaws spring-biased to close about the strike when the strike is received therebetween wherein the jaws are urged toward a closed position by an axially spring-biased ridge of the telescoping inner sleeve engaging corresponding shoulders of the jaws and wherein the motor moves a closer element and the strike grip is attached to a support floating with respect to the closer element and is spring-biased against the closer element away from the first direction.

11. The appliance latch assembly of claim 10 wherein each of the outer sleeve, the inner sleeve and the opposed jaws comprise a thermoplastic polymer material.

12. A washing appliance comprising:

a housing having a door movable from an open position permitting a loading of a washing chamber, through a close position visually covering the washing chamber but allowing outside airflow into the washing chamber, to a seal position sealing water within the washing chamber by a compression of a gasket;

a strike on one of the housing and the door;

a latch housing on the other one of the housing and the door and providing an aperture for receiving the strike from a first direction;

an electric motor;

a strike grip movable by the electric motor between an outward unlock position toward the first direction along an axis extending into the aperture and an inward locked position away from the first direction with movement of the strike grip being coaxial with movement of the strike received in the aperture;

the strike grip providing at least one spring-biased element, the spring-biased element being movable when the strike grip is in the outward unlock position to receive and releasably retain the strike in the close position in response to manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position to hold the door against the gasket in the seal position;

wherein a force required to hold the door against the gasket in the seal position is greater in magnitude than the disengagement force and the engagement force.

13. The washing appliance of claim 12 wherein the at least one spring-biased element is two opposed jaws spring-biased to close about the strike when the strike is received therebetween.

14. The washing appliance of claim 13 wherein the jaws are urged toward a closed position by an axially spring-biased ridge engaging corresponding shoulders of the jaws.

15. The washing appliance of claim 13 wherein the strike grip lock is a collar surrounding the jaws preventing them from opening to release the strike when the strike grip is in the inward locked position.

16. A washing appliance comprising:

a housing having a door movable from an open position permitting a loading of a washing chamber, through a close position visually covering the washing chamber but allowing outside airflow into the washing chamber, to a seal position sealing water within the washing chamber by a compression of a gasket; and a washing appliance system providing a washing appliance and a strike on opposite of the door and housing, the washing appliance including:

a housing providing an aperture for receiving the strike from a first direction;

an electric motor;

a strike grip movable by the electric motor between an outward unlock position toward the first direction along an axis and an inward locked position away from the first direction;

the strike grip providing at least one spring-biased element, the spring-biased element being movable when the strike grip is in the outward unlock position to receive and releasably retain the strike in the close position in response to manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position to hold the door against the gasket in the seal position;

wherein:

a force required to hold the door against the gasket in the seal position is greater in magnitude than the disengagement force and the engagement force;

the at least one spring-biased element is two opposed jaws spring-biased to close about the strike when the strike is received therebetween;

the strike grip lock is a collar surrounding the jaws preventing them from opening to release the strike when the strike grip is in the inward locked position; and the motor moves a closer element and the collar is attached to the closer element to float axially with respect to the closer element and spring-biased away from the closer element toward the first direction.

17. A washing appliance comprising:

a housing having a door movable from an open position permitting a loading of a washing chamber, through a close position visually covering the washing chamber but allowing outside airflow into the washing chamber, to a seal position sealing water within the washing chamber by a compression of a gasket; and a washing appliance system providing a washing appliance and a strike on opposite of the door and housing, the washing appliance including:

a housing providing an aperture for receiving the strike from a first direction;

an electric motor;

a strike grip movable by the electric motor between an outward unlock position toward the first direction along an axis and an inward locked position away from the first direction;

the strike grip providing at least one spring-biased element, the spring-biased element being movable when the strike grip is in the outward unlock position to receive and releasably retain the strike in the close position in response to manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position to hold the door against the gasket in the seal position;

wherein;

a force required to hold the door against the gasket in the seal position is greater in magnitude than the disengagement force and the engagement force; and the motor moves a closer element and the strike grip is attached to a support floating with respect to the closer element and is spring-biased against the closer element away from the first direction.

18. A washing appliance comprising:

a housing having a door movable from an open position permitting a loading of a washing chamber, through a close position visually covering the washing chamber but allowing outside airflow into the washing chamber, to a seal position sealing water within the washing chamber by a compression of a gasket; and a washing appliance system providing a washing appliance and a strike on opposite of the door and housing, the washing appliance including:

a housing providing an aperture for receiving the strike from a first direction;

an electric motor;

a strike grip movable by the electric motor between an outward unlock position toward the first direction along an axis and an inward locked position away from the first direction;

the strike grip providing at least one spring-biased element, the spring-biased element being movable when the strike grip is in the outward unlock position to receive and releasably retain the strike in the close position in response to manually applied engagement force from the first direction and to release the strike in response to a manually applied disengagement force opposite the first direction; and a strike grip lock blocking movement of the spring-biased element to release the strike in response to the manually applied force opposite the first direction when the strike grip is in the inward locked position to hold the door against the gasket in the seal position;

wherein:

a force required to hold the door against the gasket in the seal position is greater in magnitude than the disengagement force and the engagement force;

the motor moves the strike grip along the axis by rotating an axially threaded member engaging a correspondingly threaded support of the strike grip.

* * * * *